US006183165B1

(12) United States Patent
Heinrichs et al.

(10) Patent No.: US 6,183,165 B1
(45) Date of Patent: Feb. 6, 2001

(54) PROCESS AND DEVICE FOR SEPARATION OF PIPES OR COLUMNS FIXED IN THE GROUND

(75) Inventors: Peter Heinrichs, Wegberg; Fritz Tibussek, Monchengladbach, both of (DE)

(73) Assignee: Wirth Maschinen-und Bohrgerate-Fabrik GmbH, Erkelenz (DE)

( * ) Notice: Under 35 U.S.C. 154(b), the term of this patent shall be extended for 0 days.

(21) Appl. No.: 09/194,069

(22) PCT Filed: May 21, 1997

(86) PCT No.: PCT/DE97/01017

§ 371 Date: Nov. 19, 1998

§ 102(e) Date: Nov. 19, 1998

(87) PCT Pub. No.: WO97/44566

PCT Pub. Date: Nov. 27, 1997

(30) Foreign Application Priority Data

May 23, 1996 (DE) ..... 196 20 756

(51) Int. Cl.[7] ..... E21B 29/00; E21B 29/06; E21B 29/08; E21B 29/10

(52) U.S. Cl. ..... 405/195.1; 166/55; 166/55.2; 166/55.6; 166/55.7

(58) Field of Search ..... 405/227, 232, 405/195.1; 166/55, 55.1, 55.2, 55.6, 55.7, 55.8; 114/264, 265

(56) References Cited

U.S. PATENT DOCUMENTS

| | | | | |
|---|---|---|---|---|
| 1,755,206 | | 4/1930 | Church . | |
| 2,728,138 | * | 12/1955 | Guild | 405/227 |
| 2,915,819 | | 12/1959 | O'Day . | |
| 2,991,834 | | 7/1961 | Kennard . | |
| 3,331,439 | | 7/1967 | Sanford . | |
| 3,338,305 | * | 8/1967 | Pittman et al. | 405/227 |
| 3,782,459 | * | 1/1974 | Murray | 166/55.6 |
| 4,039,025 | | 8/1977 | Burkhardt . | |
| 4,389,765 | | 6/1983 | Thompson . | |
| 4,646,826 | * | 3/1987 | Bailey et al. | 166/55.3 |
| 4,768,899 | * | 9/1988 | Dysarz | 405/195 |
| 4,799,829 | * | 1/1989 | Kenny | 405/195 |
| 4,808,037 | * | 2/1989 | Wade et al. | 405/226 |

(List continued on next page.)

FOREIGN PATENT DOCUMENTS

| | | |
|---|---|---|
| 671 660 | 2/1939 | (DE) . |
| 481 767 | 10/1991 | (EP) . |
| 2 211 446 | 7/1989 | (GB) . |
| 2 251 015 | 6/1992 | (GB) . |
| 93/19281 | 3/1993 | (WO) . |

OTHER PUBLICATIONS

International Search Report, dated Sep. 12, 1997.

International Preliminary Examination Report dated Aug. 10, 1998.

"Standardized Platform Removal Equipment Can Cut Costs and Time"; *Offshore*, Aug. 1989.

*Primary Examiner*—Eileen D. Lillis
*Assistant Examiner*—Gary S. Hartmann
(74) *Attorney, Agent, or Firm*—Vickers, Daniels & Young

(57) ABSTRACT

To separate relatively long upright pipes (13) which have a relatively large diameter, the lower end thereof being fixed in the ground, in particular of support legs (3) of an off-shore oil bore or conveying platform (100), a cutting unit is lowered down into the pipe (13) to a separation point. The cutting unit (40) acts gradually from the inside across the periphery to the internal periphery of the pipe (13) and cuts through the pipe (13) by removing metal. A bore tool head (60) is mounted upstream of the cutting unit (40), viewed from the lowering position, and is used to bore out material in the pipe such as ocean bed or concrete.

27 Claims, 6 Drawing Sheets

U.S. PATENT DOCUMENTS 4,856,938 * 8/1989 Kuehn ..... 405/227
5,090,480 * 2/1992 Pittard et al. ..... 166/298
5,242,017 * 9/1993 Hailey ..... 166/55.8
5,253,710 * 10/1993 Carter et al. ..... 166/298
5,385,205 * 1/1995 Hailey ..... 166/55.8
5,823,255 * 10/1998 Swiatowy et al. ..... 166/55.1

* cited by examiner

A
143
114
122
121
142
138 A
141
136'
136
140
135
134
138
137
142
138 B
132
129
125
123
13
9
126
124
131
127
133
128
128
133
127
132
129
123
126
124
26,126
13
A
40,140
26,126
224
13
B
A
B
231
240
224

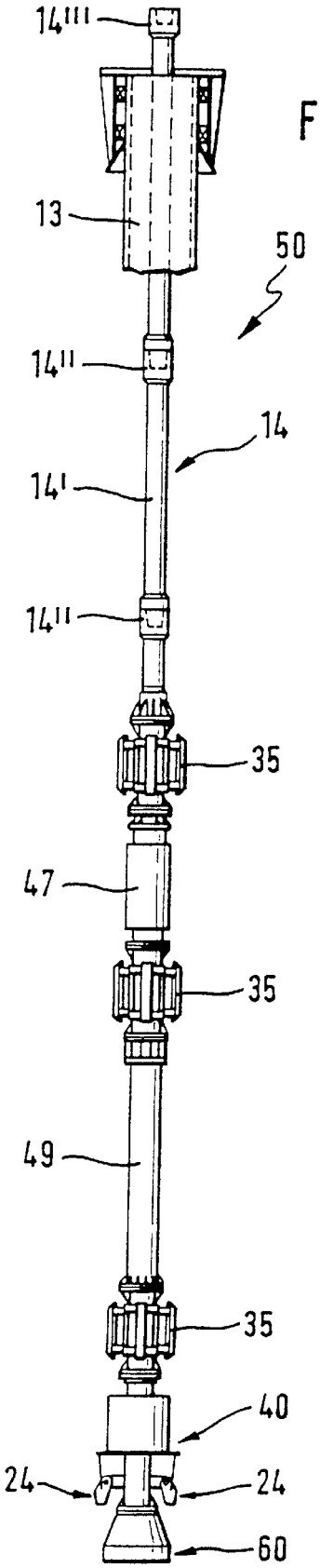
Fig. 8
Fig. 9
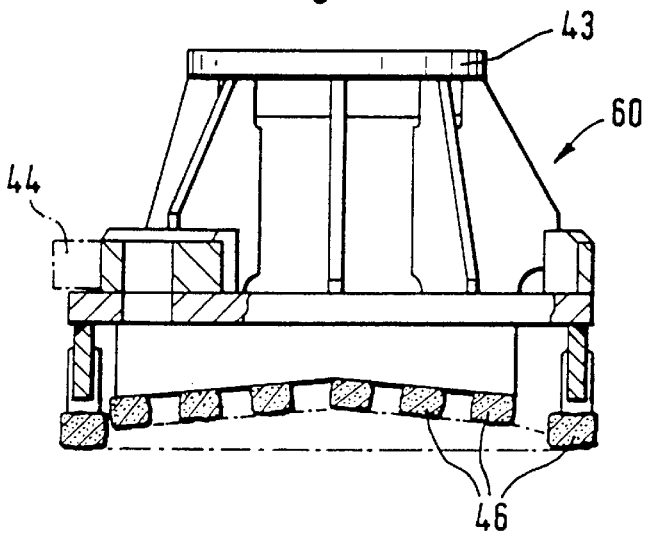
Fig. 10
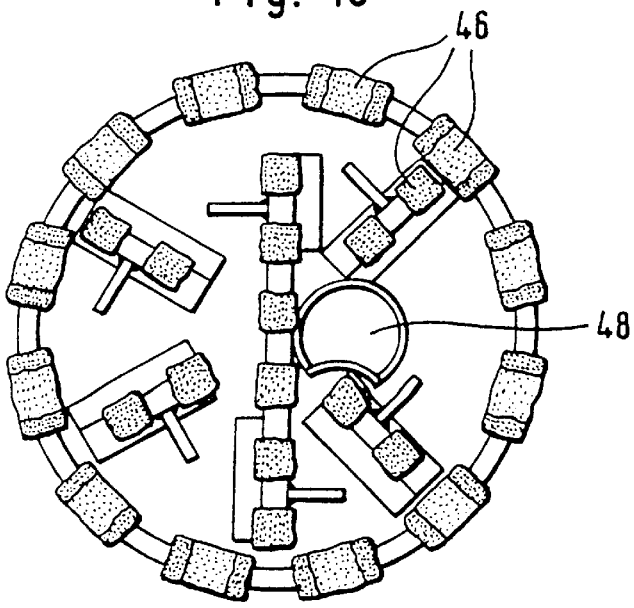

PROCESS AND DEVICE FOR SEPARATION OF PIPES OR COLUMNS FIXED IN THE GROUND

SUMMARY

For separation of upright pipes (13) with their lower ends anchored in the ground having a longer length and larger diameter, particularly of support legs (3) of an offshore oil rig or oil platform (100), a cutting unit is lowered into the pipe (13) down to a separation point (9). The cutting unit acts upon the circumference advancing from the inside against the inside circumference of the pipe (13) and cuts through the pipe (13) using chip removal. In the lowering direction, seated downstream from the cutting unit (40) is an auger head (60), which serves to drill out material, such as ocean floor matter or cement, found in the pipe. (FIG. 8)

BACKGROUND OF THE INVENTION

Method and device for separating pipes or columns that are anchored into the ground The invention relates to a device and a method for separating upright pipes having their lower end anchored into the ground, particularly for support legs of an offshore oil drilling or oil supply platform.

To win the numerous crude oil reservoirs, drilling has been conducted for some time not only from oil fields accessible by land, but also offshore fields located under the ocean floor and other bodies of water. Such drills have been sunk at various water depths and, in part, far from the coast. In principle, the structure above the water surface, is the same drilling rig as is used on land, only on a supply platform positioned above the water surface. The type of support for the supply platform on the ocean floor is dependent, in part, on the water depth. Most offshore oil supply platforms are anchored into the ocean floor by means of support legs formed from large pipes.

Depending on the condition of the ocean floor, the support legs are embedded into the ocean floor, for example, rammed in or retained by the friction in the ocean floor. If this is insufficient, there is an alternative in which the embedded base of the support legs is installed in underwater cement or something similar, which also partially has an outlet in the surrounding ocean floor from the lower end of the pipe and which forms an artificially created ocean floor after hardening, the anchoring effect of which is contributed to by the effect of the weight of the cement, which fills up the lower part of the respective pipe up to a certain height. Using these measures, the supply platforms obtain stability under load even in problematic underground situations, which provide resistance to the platforms under the extreme loads in high seas.

The first of these platforms has operated in the North Sea for approximately 20 to 25 years. They are no longer needed in the meantime because the oil fields that were drilled with these platforms have been exploited. They cannot simply be left standing because they pose a hazard for ship travel.

Therefore, there is a need for a method and devices with which the oil supply platforms can be removed from the ocean after their service life has passed. While the removal of the structures of the platform and the platform itself are similar in principle to those used for land-based oil rigs, the support structures or platforms that are, in part, in deep and moving water, pose considerable problems. The support legs also need to be removed, but for the reasons indicated, cannot simply be cut off above sea level or just below the ocean surface, rather the specifications from the responsible authorities require that the support legs be cut off a section below the ocean floor.

From DE-PS 671 660, a device for cutting through pipes embedded in well drill holes is known, the cutting tool of which is lowered into the pipe to the separation point by means of a rod assembly. The cutting tool is used at the inside wall of the pipe and cuts through it from the inside to the outside.

This device is not suited for separating support legs of the platform indicated because the separation point is always in a region of the support leg that is filled with ocean floor matter, cement, and other things and thus does not permit lowering of the separation point.

Therefore, it was attempted to have diving teams dive to the ocean floor with suitable equipment and to cut the support leg from the outside using a diamond wire placed about the support leg driven in a longitudinal direction. Due to the large thickness of the pipe wall, this is a time-consuming and not necessarily non-dangerous process for the dive teams.

SUMMARY OF THE INVENTION

The object of the invention is to accomplish a device and a method with which the pipe of long length and large diameter, such as the support columns of offshore oil supply platforms, can be cut off quickly and economically, in spite of materials found in the pipes, such as dirt or cement, even when below the ocean floor.

This object is accomplished methodologically by the subject of claim 1.

According to the invention, a cutting unit is used for this purpose, which is inserted through the upper open end of the support leg and is lowered therein to the separation point, whereby when lowering the cutting unit, the material found in the pipe is drilled out down to the separation point. With this measure, the drilling and cutting are achieved in one work action and thus can be implemented particularly quickly and economically.

A configuration of this method as defined in claim 2 is particularly advantageous, in which a cutting unit is brought into action by means of a chip-removing cutting tool at the inside circumference of the pipe and cuts through the pipe in a circumferential direction advancing from the inside toward the outside. A chip-removing separation method is fast because in this way, thick chips are removed from the relatively soft structural steel of the pipe and a groove with high advance and high clearing output can be created in the narrow separation zone extending in a circumferential direction until the separation of the entire material cross-section. Since the separation is achieved from the inside, it is irrelevant where the separation point is with regard to the ocean floor; the method is not influenced in its function by the existing outside relationships.

To prevent the weight of the support legs and the other construction points still associated with it from causing the pipe being cut to sink, which could wedge the cutting unit in and cause damage to the cutting unit, it is useful to stay the weight of the pipe as defined in claim 3, which can be achieved using a method still to be described by supporting the parts of the support structure on the adjacent support legs still standing.

The object is instrumentally achieved by means of a device as defined in claim 4, which is characterized in that a rotatable, drivable auger head is disposed below the cutting unit, by means of which head, material located in the lower region of the pipe, such as ocean floor matter or cement, among other things, that are somewhat above the inside cross-section of the pipe down to the separation point or somewhat above, can be drilled out. The diameter of the bore corresponds at least to the diameter of the cutting unit. This allows for the cutting unit to be lowerable to the separation site. Hence, the lowering movement by the cutting tool is not hindered.

The cutting unit as defined in claim 2 preferably comprises at least one radially chipping cutting tool that can be pressed against the inside circumference of the pipe and that is movable by means of a mechanical drive, having a contact point that can be displaced in a plane progressing in a circumferential direction essentially vertical to the pipe axis. Only after the cutting point has been reached is the cutting tool extended out radially and set for chip cutting the pipe by creating an inside circumferential groove against its inside circumference that ultimately goes through the thickness of the wall.

To accelerate the actual cutting process, a configuration of the device as defined in claim 6 is recommended in which the cutting unit comprises a plurality of cutting tools distributed symmetrically about the pipe axis, which tools are simultaneously brought into action in the same separation groove.

In a preferred specific embodiment as defined in claim 7, the mechanical drive is configured as a fluid-driven piston/cylinder unit.

As defined in claim 8, this configuration can be driven by means of hydraulic fluid or, as defined in claim 9, by means of compressive force.

In the latter example, a configuration as defined in claim 10 is advantageous. This configuration acts such that air rising through the hollow rod assembly above the platform signals the complete separation of the pipe. Hence, the cutting action can be stopped immediately thereafter, thereby preventing increased wear or even breakage of the cutting tools due to friction of the same on the edges of the separation groove and in the ocean floor material found on the outside of the pipe.

During the drilling to reach a separation point, it is often not possible to drill out the underwater cement found in the pipe exactly up to the inside circumference of the pipe. This applies particularly if the pipe is no longer completely round. Under some circumstances, a layer of cement could remain on the inside wall of the pipe, which cement could damage the cutting tools during their subsequent use.

To prevent this, a cleaning apparatus as defined in claim 11 is recommended, which cleans the work area of the cutting tools of residue from adhering material before engaging the cutting tools. The cleaning apparatus can comprise a brush-like configuration of cleaning elements, for example.

Since the support legs of the offshore oil rigs or oil supply platforms of issue can be of considerable weight and can be subject to stress from remaining parts from the actual platform and the framing braces under certain circumstance, it could happen that the support leg gives in axially at the separation point during the separation process and thereby wedging in the cutting tools.

It is therefore recommended, as defined in claim 12, that a support apparatus be provided that stays the weight of the pipe during the separation process.

The support apparatus can, according to a configuration as defined in claim 13, comprise a previously separated adjacent pipe of a support pipe exhibiting an approximately equal length, which pipe rests on the lower end in the pipe on the ocean floor or the pipe foundation formed by the underwater cement and which can be connected at the upper edge to the separated pipe, as can be achieved by means of a hydraulically braced conical-tensioning connection according to the method described in claim 14. In this way, the separated pipe is held upright with the adjacent platform parts such that the pipe in which the cutting unit is currently working is not so heavily burdened.

Specific embodiments of the invention are described in detail below by way of the drawings.

BRIEF DESCRIPTION OF THE DRAWINGS

FIG. 8 schematically, a specific embodiment in which the cutting unit and the auger head are arranged on a drilling rod assembly;

FIG. 9 a side view of the auger head from FIG. 6 in an enlarged scale;

FIG. 10 a view of the auger head from FIG. 9 from below, as well as

DETAILED DESCRIPTION

Figure 1:
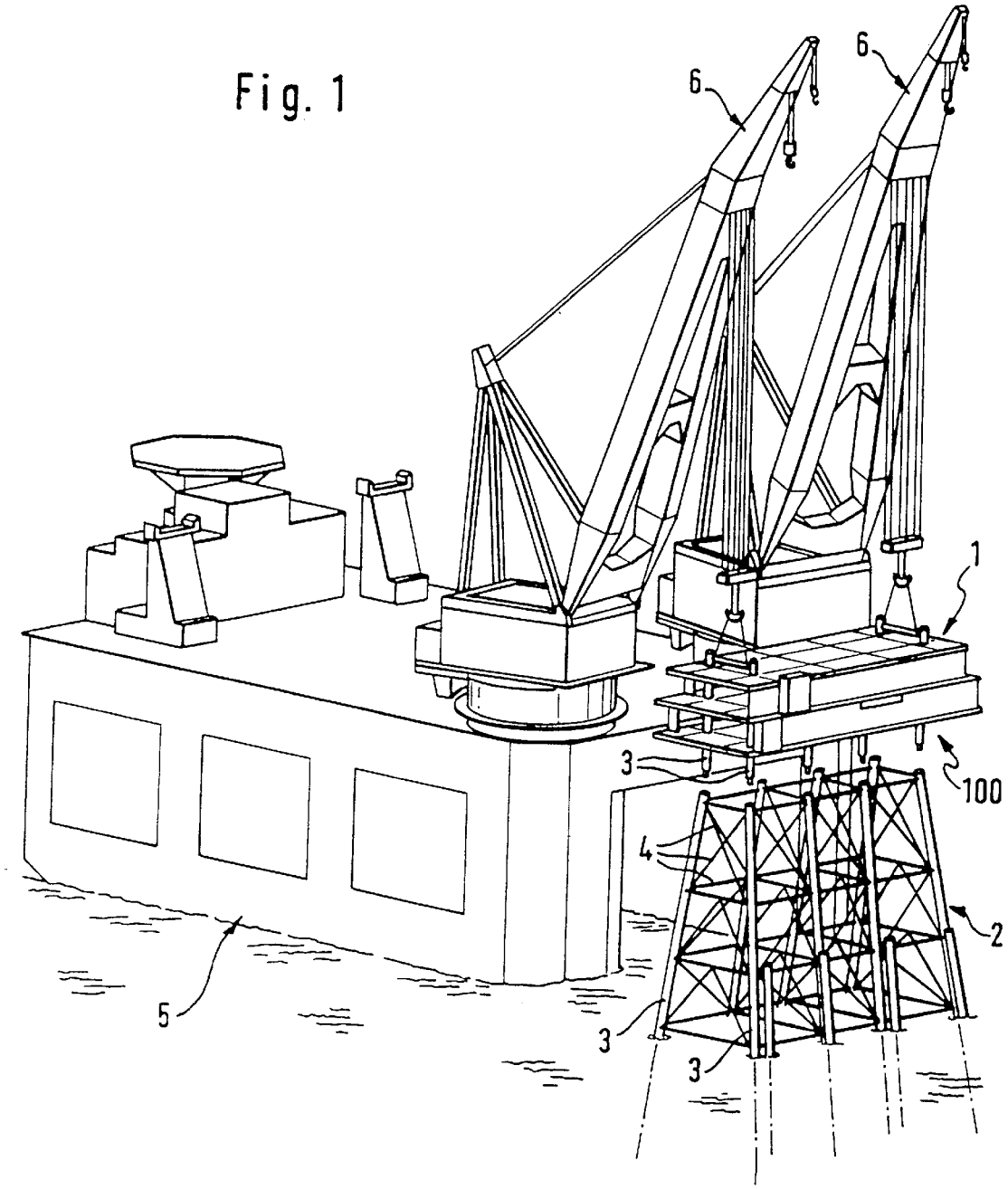
FIG. 1 perspectively, a support structure with a supply platform lifted off.

FIG. 1 illustrates oil rig or oil platform 100 already separated into its main component parts, comprising actual platform 1, which is supported in an assembled condition on a support structure designated entirely by 2. The entire equipment, such as the drill apparatus, housing, etc., which is normally arranged on platform 1, is already dismantled and no longer indicated in the drawing. For the assembly and dismantle of oil rigs or oil platforms 100 and/or support structures 2, crane ships 5 are used, which exhibit cranes 6 having a lift height that can be 200 meters or more above the sea level. In the phase illustrated, actual platform 1, after being disconnected from support structure 2, is suspended from cranes 6.

Only the part of support structure 2, which can be 30 to 40 m high, that is above sea level 10 (FIG. 2) is illustrated in FIG. 1. Support structure 2 is configured as a tower-like or trestle-like framing with support legs 3 and truss-like cross braces 4 and is anchored below the water surface in the ocean floor by means of its support legs 3 that extend downward (indicated by dashed lines) into the water. The water can be over 100 m deep and each support leg 3 can be embedded in, that is rammed into, the ocean floor by a comparable length. Support legs 3 are thus very long. They consist of large pipes 13 with a 1 to 2 m diameter and a considerable wall thickness of 30 to 50 mm. The number of support legs 3 is dependent on the set-up of support structure 2.

Figure 2:
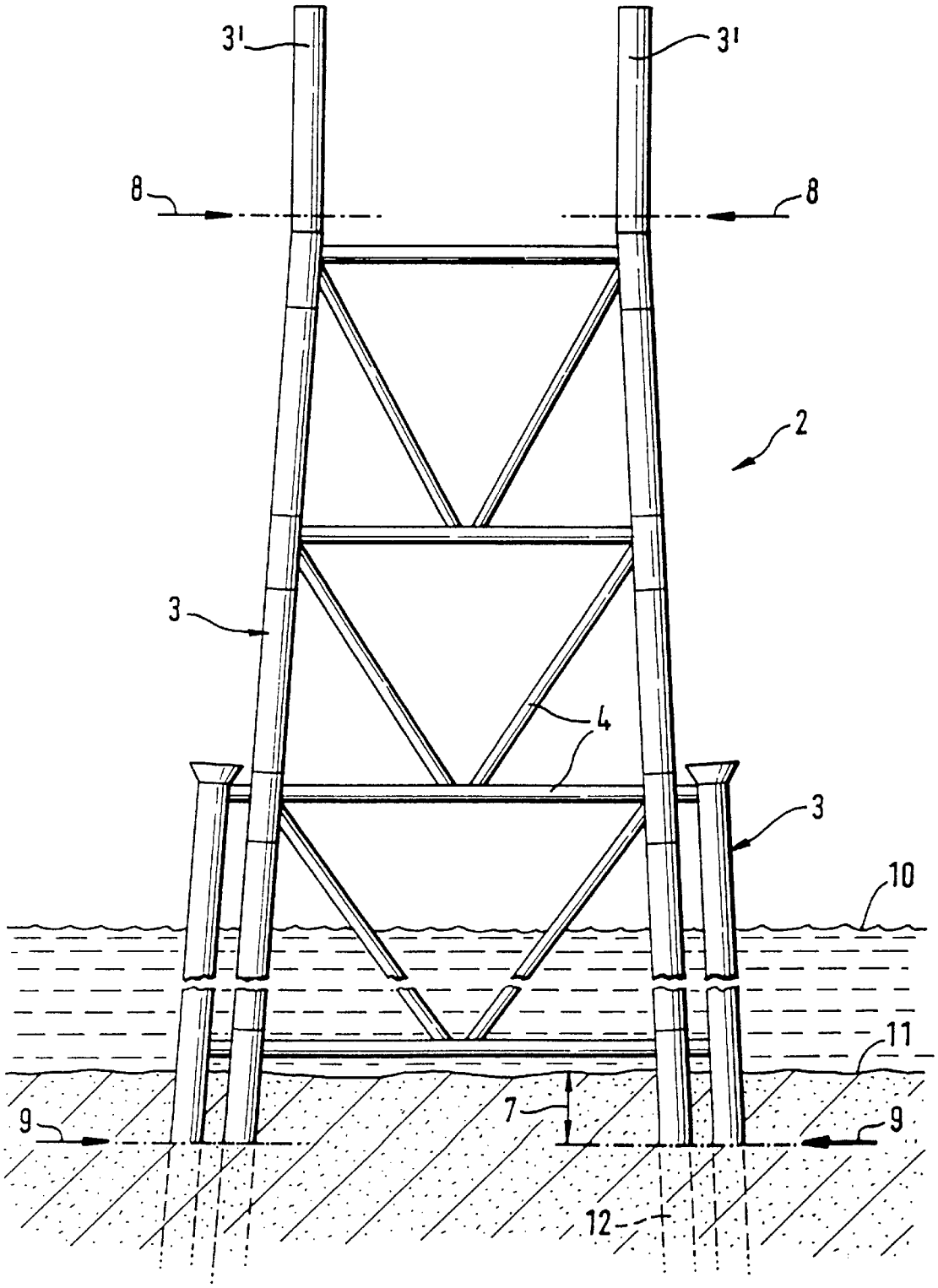
FIG. 2 schematically, a side view of a support structure.

FIG. 2 indicates the dismantled situation of support structure 2, which deviates somewhat in design from FIG. 1. Upper parts 3' of support legs 3 are cut off at separation point 8 and still belong to actual platform 1, which is lifted off of support structure 2 by cranes 6 in accordance with FIG. 1. Support structure 2 projects above sea level 10 and extends downward to ocean floor 11 by a length corresponding to the water depth. Support legs 3 extend deep into ocean floor 11 and can be anchored in a foundation-like manner at their lower ends in ocean floor 11 either by underwater cement or similar means. For oil rig or oil platform 100, support legs 3 must be separated at separation points 9, which lie several meters below ocean floor 11 at distance 7, from their lower ends 12, which extend deep into ocean floor 11 at separation points 9. While the separation at separation points 8 poses no problems due to good accessibility, separation points 9 lie below water surface 10 and within ocean floor 11 and are likewise difficult to reach.

Figure 3:
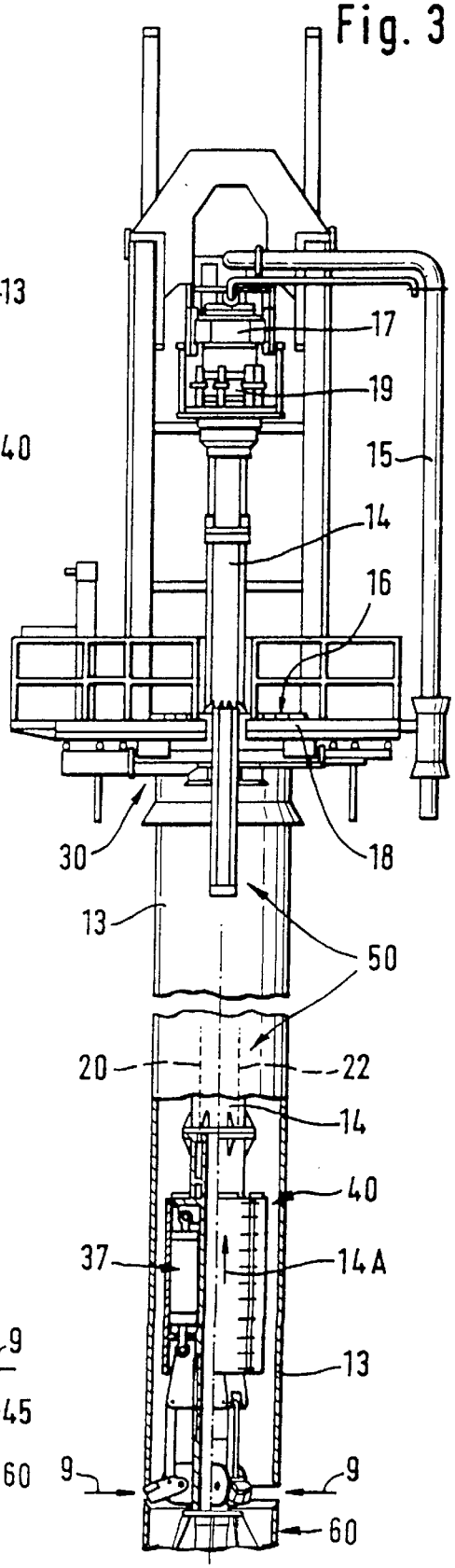
FIG. 3 schematically, a side view, partially cut away, of a device according to the invention having a first specific embodiment of the cutting unit in a pipe that forms a support leg.

For this reason, a separation device—designated in its entirety by 50 in FIG. 3—is provided so that it can be lowered into the inside of respective pipe 13 and that it can be engaged at the inner circumference of the pipe; the separation device further comprising a cutting unit—designated in its entirety by 40—that has a drive apparatus 30. Viewed in the lowering direction, provided downstream from cutting unit 40 at the lower end of rod assembly 14 is auger head 60, the set-up and function of which are described based on FIG. 9 and FIG. 10.

The upper half of FIG. 3 illustrates such drive apparatus 30 disposed at the upper end of pipe 13 to be cut and as part of a customary air-lift drill apparatus as well as rotatingly driven hollow rod assembly 14 extending downward into pipe 13, wherein cutting unit 40 is non-pivotably mounted in the lower region of the rod assembly, the set-up and function of which unit are described in detail below.

Turntable drive 16 can be used in drive apparatus 30, as is known for the drive of an auger head of an air-lift drill apparatus from the related art. Hence, existing drive apparatuses can be used, which only exhibit modifications if necessary. To drive cutting unit 40 and auger head 60, rod assembly 14 extends into pipe 13 to be cut over its upper end such that it can be driven from the outside above the upper end of pipe 13 by means of turntable 18 by way of a toothed gear mounted at the circumference of the rod assembly.

So-called flushing head 17 is arranged at the upper open end of rod assembly 14, by means of which head the material loosened on the floor of an earth drilling during the drill operation is flushed away through the inside cross-section of rod assembly 14 straight through in the direction of arrow 14A in line 15 according to the air-lift method. The functionality of flushing head 17 and the air-lift method are known from the related art and are not clarified further here. Below flushing head 17, a rotary connection head, designated by 19, is disposed, by means of which compressed air for the air-lift method and an additional fluid medium (air or a hydraulic fluid) can be delivered even at high pressures into one or a plurality of lines 20 and 22, which extend parallel in or to rod assembly 14.

Figure 4:
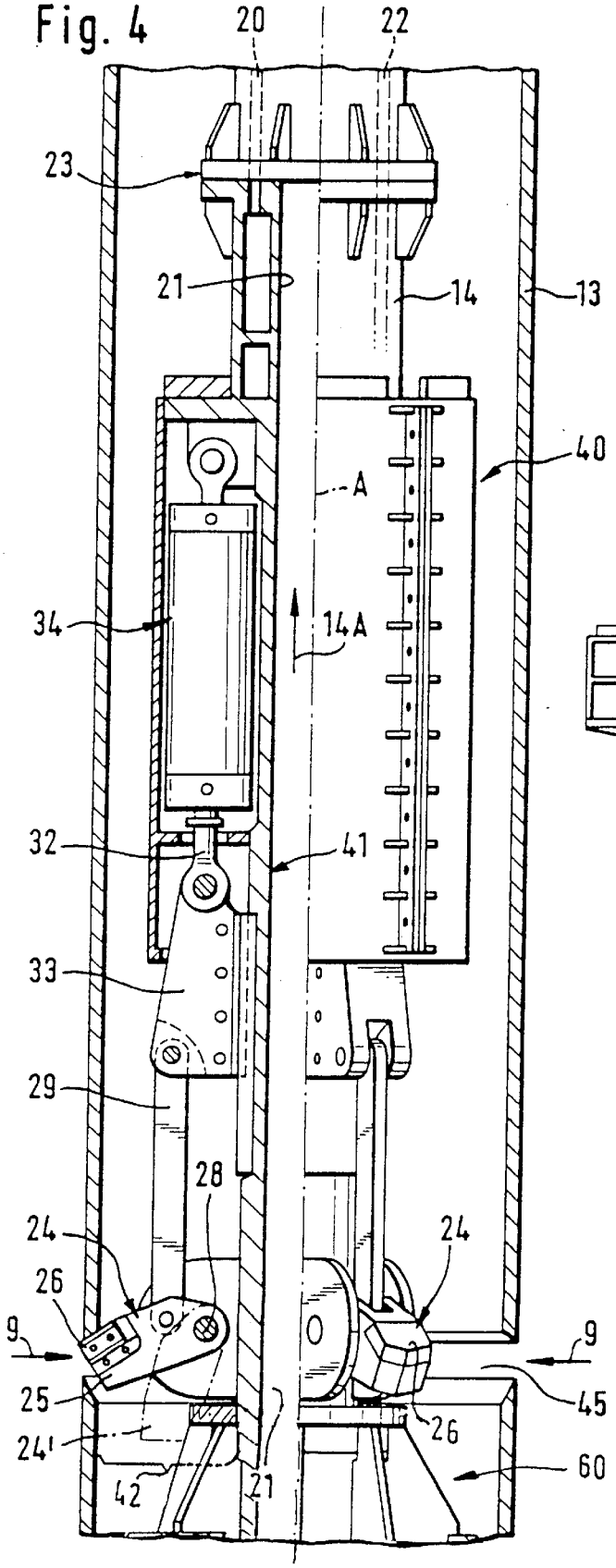
FIG. 4 an enlarged section from FIG. 3.

FIG. 4 illustrates an enlarged view of cutting unit 40 from FIG. 3 mounted non-pivotably at the lower end of rod assembly 14. Inside of rod assembly 14, line 20 for compressed air and line 22 for compressed air or a hydraulic fluid are indicated in outlines. The drilling of loosened material while drilling on the ground can be supplied with compressed air in the direction of arrow 14A to the surface by means of flushing channel 21 formed in the inside of the rod assembly. To lower cutting unit 40 inside of pipe 13 to be cut, rod assembly 14 is extended downward in stages by means of flange connections 23 (see also FIG. 6), until cutting unit 40 is lowered to the level of separation point 9. The torque (rotary movement) necessary for chipping is introduced to cutting unit 40 by means of turntable 18 and rod assembly 14, that is entire rod assembly 14 including cutting unit 40 is rotated within pipe 13 about its axis A. Cutting unit 40 comprises a central section 41 inside the interior of which flushing channel 21 is formed and the outside dimension of which is only approximately one-third of the inside diameter of pipe 13 in the exemplary embodiment, such that annular interim area 42 remains.

In the example illustrated, cutting unit 40 comprises three pivotable cutting tools 24 distributed symmetrically about the circumference of rod assembly 14. Each cutting tool 24 in FIG. 3, FIG. 4 and FIG. 8 exhibits one mechanical drive 34 allocated exclusively to it in the exemplary embodiment, which drive can consist of a fluid-driven piston/cylinder unit. The fluid can be compressed air, the pressure of which is limited, however, or a hydraulic fluid, with which higher pressures and thus actuation forces of mechanical drive 34 are achievable. The compressed air or hydraulic fluid is supplied via line 22 such that individual cutting tools 24 are actuated synchronously and with equal forces. It is understood that each mechanical drive 34 can have its own line available. Cutting tools 24 with their mechanical drives are arranged in annular interim area 42.

If mechanical drives 34 are actuated with compressed air, a connection—not depicted in the drawing—can exist between the working volumes of at least of one cylinder and the inside of rod assembly 14, which connection is configured such that it opens if the piston of this mechanical drive 34 is in its end position corresponding to the extended position of cutting tool 24 assigned to it. This measures affects that air rising in rod assembly 14, which can be observed for example on flushing head 17, signals the complete separation of the pipe. The separation process can then be stopped immediately, thereby preventing that the cutting tools wear prematurely from unnecessary friction at the edges of the separation groove or are completely destroyed by penetrating through into the ocean floor outside of the pipe.

Each cutting tool 24 consists of a long base body 25 to which one end of cutting plate 26 is secured. Cutting plates 26 are formed from reversible plates consisting of material suitable for heavy chipping. Base body 25, at its end facing cutting plate 26, is seated on tangentially swiveling journal 28 disposed on the outside circumference of central section 41 horizontal to a circle about axis A. Connecting rod 29, which is connected to the mechanical drive, is engaged between swiveling journal 28 and cutting plate 26, by means of which connecting rod cutting tool 24 can be displaced radially outward during an upward movement of connecting rod 29 by pivoting about swiveling journal 28 downward from transport position 24' indicated in FIG. 4 by a dotted line, until cutting plate 26 comes into contact at the inside circumference of pipe 13 and pipe 13 is chip cut at separation point 9 from the inside toward the outside by forming separation groove 45, which extends progressively in a plane vertical to axis A.

In the specific embodiment illustrated in FIG. 3, FIG. 4 and FIG. 8, mechanical drive 34 is configured as a piston/cylinder unit, which is fixedly arranged in interim area 42 at the outside circumference of the central section parallel to axis A and which has piston rod 32 connected to be movable to connecting rod 29 by means of slide 33 guided on central section 41. During the lowering movement of cutting unit 40, the cylinder of the piston/cylinder unit is in its fully extended position (further down than illustrated) such that cutting tool 24 is aligned essentially lengthwise to axis A (position 24') and is free from pipe 13. To press cutting plate 26 against the inside circumference of pipe 13, the piston of the piston/cylinder unit is moved upward by means of line 22 and base body 25 of cutting tool 24 pivots radially outward. By means of the pressure supplied by compressed air or hydraulic fluid through line 22, the contact pressure of cutting plate 26 on the pipe inside wall is adjustable for influencing the cutting result. As soon as pipe 13 is cut through completely, the piston is moved downward and cutting tool 24 is pressed back to its initial position 24', such that cutting unit 40 can be pulled out, upward from separated pipe 13.

The pivoting of cutting tool 24 to the pipe inside wall or the actuation of the piston/cylinder unit can be achieved by numerous methods known to specialists in the field. If a plurality of lines 22 are present, piston 32 can also be impinged upon by pressure alternately in both directions; the restoring moment can be affected by way of springs or similar means.

Figures 5, 6, 7:
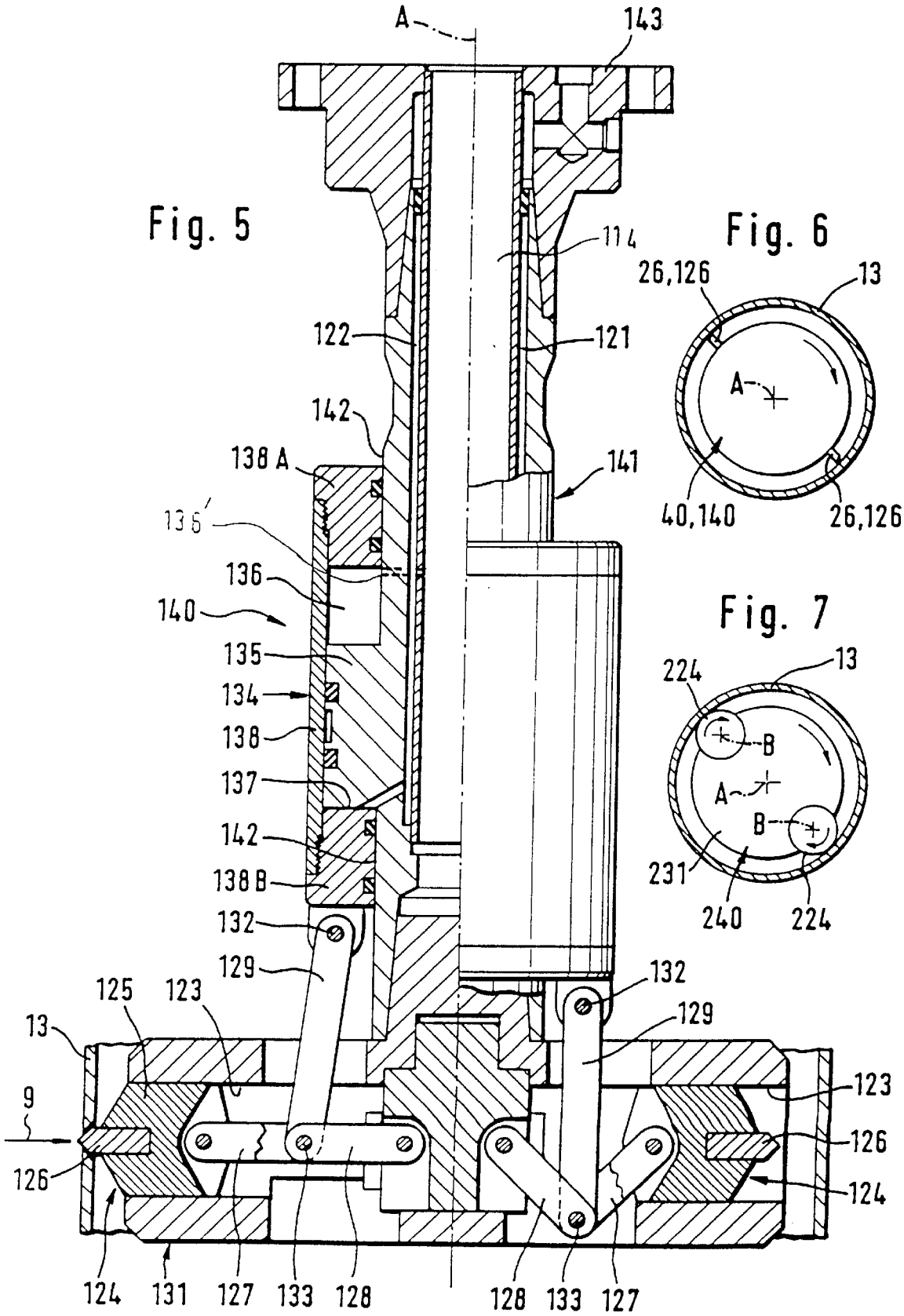
FIG. 5 an alternative specific embodiment of the cutting unit with a linear guide for the cutting tools.
FIGS. 6 and 7 schematic representations of the coming cutting principles.

Alternatively to the radial pivot about a horizontal axis, the base body of the cutting tool can also be moved linearly. In FIG. 5, cutting unit 140 is illustrated with a radial guide of base body 125 of cutting tool 124 linear to axis A of cutting unit 140 or pipe 13, wherein the linear guides are formed in tool guide body 131, which is disposed at the lower end of central section 141, exhibiting flange 143 at its upper end for connection to rod assembly 14. Base bodies 125 of cutting tools 124 can be displaced in radial guide channels 123 of tool guide body 131. In the left half of FIG. 5, cutting tool 124 is illustrated in is extended condition; in the right half, in its retracted condition. One leg 127 of an articulated lever is connected at the end of base body 125 facing pipe axis A and extends up to articulated joint 133, while the other leg 128 of the articulated lever is connected centrally near pipe axis A starting from articulated joint 133. One end of joint rod 129, which extends lengthwise to axis A, contacts articulated joint 123 of the articulated lever, the other end of the joint rod is connected to mechanical drive 134 by means of pivot pin 132.

In contrast to the specific embodiment according to FIG. 3, FIG. 4 and FIG. 8, only one piston/cylinder unit is provided here as mechanical drive 134, which jointly drives all of cutting tools 124.

The piston/cylinder unit exhibits pistons 135 configured at central section 141. The cylinder from the piston/cylinder unit is configured as sliding cylinder 138 surrounding piston 135, end plates 138A, 138B of which sliding cylinder slide on cylindrical outside circumference 142 of central section 141 for both sides of piston 135 projecting out radially and which form pressure chambers 136,137 with piston 135, which are impinged upon by compressed air or hydraulic fluid, as desired. To move base body 125 of cutting tool 124 outward in respective guide channel 123, compressed air or hydraulic fluid from upper pressure chamber 136 is supplied such that sliding cylinder 138 is pressed upward and articulated joints 127,128 are extended by means of connecting rod 129 connected to sliding cylinder 138, such that cutting inserts 126 of cutting tools 124 are set linearly against the inside circumference of pipe 13 to be cut.

If the sliding cylinder is driven by compressed air, then channel 136' extending to the inside of rod assembly 114 can be provided at the upper end of upper compressed air chamber 136, the outlet of which channel is released into upper pressure chamber 136 if sliding cylinder 138 is in its upper end position limiting the extended position of cutting tools 124. Air rising in the inside of rod assembly 114 signals in turn the end of the separation process.

In the configuration illustrated in FIG. 5, which is dimensioned such that the approach—reproduced on the left side—to the extended position of articulated lever 127,128 occurs during the engagement of cutting insert 126 in the wall of pipe 13, a high contact pressure by cutting inserts 126 against pipe 13 and a corresponding chip thickness at separation point 9 can be achieved in a simple manner. To lower cutting unit 140 with cutting tools 124 retracted into pipe 13 and to lift it therein, lower pressure chamber 137 is supplied with compressed air or hydraulic fluid such that due to the downward movement by sliding cylinder 134, connecting rod 129 and thus elbow 123 of the articulated joint are moved downward and cutting tools 124 are thereby driven inward into guide channels 123, as illustrated on the right side of FIG. 5.

The operational method of the cutting unit is illustrated primarily in principle in FIG. 6 and FIG. 7.

FIG. 6 corresponds to the specific embodiment described thus far. Cutting unit 40,140, which can rotate about axis A in pipe 13, exhibits cutting inserts 26, 126, which can be displaced radially outward from cutting unit 40,140 and which conduct a rotary movement along the inside circumference of pipe 13 only about axis A. Cutting inserts 26,126 act like interior tapping tools.

An alternative specific embodiment is illustrated in FIG. 7, in which cutting unit 240 can rotate about axis A, yet does not carry any radially extendable cutting inserts, rather rotatable cutting tools 224 on a tool carrier 231, which tools can rotate about axis B parallel to axis A at the edge of the cutting unit and make milling contact at the inside circumference of pipe 13. Cutting tools 224 thus rotate both about axis A and axis B. They can be configured like a milling-cutter.

FIG. 8 illustrates separation device 50 as an entire unit with cutting unit 40, which can be rotated on rod assembly 14, in accordance with FIG. 3 and FIG. 4. The rod assembly consists of a plurality of rod elements 14' placed in stages one after the other on coupling points 14" and extends from the top into pipe 13, of which only the uppermost part is illustrated in FIG. 8. To fix rod assembly 14 radially within pipe 13, stabilizers 35 are arranged in intervals axially to one another, which lie against the inside wall of pipe 13 and in which rod assembly 14 is seated and can rotate freely. Switch valve 47 is installed in rod assembly 14 between two stabilizers 35, with which valve the change of direction of the radial pivoting movement of cutting tools 24 can be controlled. As is known from drilling operations, stabilization rod or heavy rod 49 can be installed as the lowest rod in rod assembly 14. At the upper end of rod assembly 14, free coupling point 14'" is provided for decoupling additional rod elements 14' or drive apparatus 30 (FIG. 3). Cutting unit 40 is arranged at the bottom end of rod assembly 14.

With cutting units 40 from FIG. 3 and FIG. 4 and 140 from FIG. 5, respective specified separation point 9 can only be reached if pipe 13 is cleared to that point. In many cases, pipe 13 is filled with ocean floor matter or underwater cement, however, which can lie above separation point 9.

Therefore, auger head 60 is secured below cutting unit 40 or 140, which can be seen below cutting unit 40 in FIG. 3, FIG. 4 and FIG. 8 and in enlarged view in FIG. 9 and FIG. 10.

The object of auger head 60 is to drill out down to separation point 9 material found in the lower section of pipe 13 to be cut so that cutting unit 40 can reach specified separation point 9. To transport off material drilled away by auger head 40, the air-lift method indicated briefly in reference to FIGS. 3 and 4 is used. When drilling out pipe 13, the apparatus functions like a customary earth drill; cutting unit 40 is thereby without function with its cutting tools retracted. It is only put into operation after the drilling is completed.

The separation of pipe 13 therefore occurs by using existing drill units and technology, wherein only cutting unit 40 is to be inserted between auger head 60 and rod assembly 14 and is provided with supply lines.

Auger head 60 illustrated in FIG. 9 exhibiting a somewhat annular contour is connected by means of upper flange 43 to a counter flange provided at the lower end of cutting unit 40. As illustrated in the bottom view in FIG. 10, at the bottom of auger head 60, drill bodies 46 or roller bits prepared with hard metal are permanently arranged, by means of which the underwater cement found in the inside cross-section of pipe 13 to be cut can be drilled away. Suction opening 48 serves the air-lift method and is connected with the inside cross-section of rod assembly 14 (not illustrated).

When drilling out pipe 13, cement layers adhering to the inside circumference of pipe 13 can remain, which can damage or destroy cutting plates 26,126 of cutting tools 24,124 when placed against the inside circumference of pipe 13. To prevent this, a cleaning apparatus having radially extendable brush-like or scraper-like cleaning elements 44 can be provided on auger head 60, by means of which apparatus adhering cement is removed down to the metal of pipe 13 before cutting tools 24,124 are brought into action.

Figure 11:
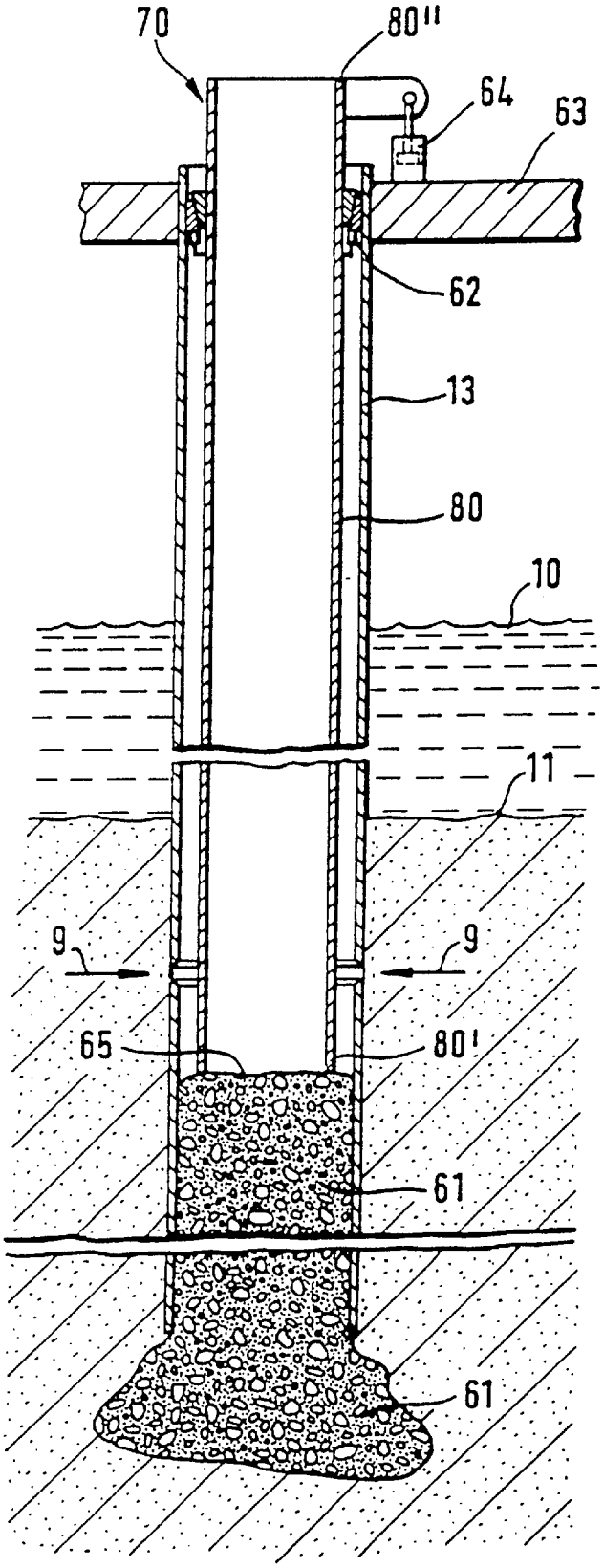
FIG. 11 schematically, a support apparatus arranged in one of the previously separated support legs.

FIG. 11 illustrates support apparatus 70 with which the weight of applicable pipe 13—itself adjacent to previously cut pipe 13—burdens pipe 13 to be cut, and thereby the remaining platform structures can be stayed. Illustrated is a support leg currently working adjacent at separation point 9 of previously cut pipe 13. After the cutting unit including the rod assembly or the cable is pulled out, additional support pipe 80, having a smaller diameter and a longer length than the length of pipe 13, is lowered into cut pipe 13, as a result of which it stands above the upper end of pipe 13 and the related remnant 63 of the platform. Pipe 13 is filled below with underwater cement 61 up to upper limit surface 65. Support pipe 80 rests by its lower end 80' on limit surface 65. Just below upper end 80" of support pipe 80, conical-tensioning connection 62, which can be hydraulically clamped, is arranged in the interim area between support pipe 60 and the inside circumference of pipe 13. The part of support pipe 80 protruding out of pipe 13 is provided with hydraulic lift cylinder 64, which contacts remnant 63 of the platform. When activating lift apparatus 64, remnant 63 is pulled up on support pipe 80. Thus, the upper part of pipe 13 is taken along. A defined distance is specified between the fastening of lift cylinder 64 and the top of remnant 63 of the platform, which distance shall be maintained during the entire separation process of the other support legs. A gap is thereby formed at separation point 9. By means of conical-tensioning connection 62, a constant tension is achieved between the support pipe and pipe 13 such that it is no longer applied to the continuous maintenance of pressure in lift cylinder 64. The previously cut pipes adjacent to pipe 13 to be cut and the related remnant 63 of the platform are safely lifted up in this way such that the entire structure settles together at separation point 9 of pipe 13 currently being worked on. Without the support apparatus, cutting inserts 26, 126 could become wedged inside circumferential groove 45 (FIG. 4) formed at separation point 9 during the separation process of pipe 13 currently being worked on, if the remaining wall cross-section of pipe 13 is no longer equal to the load.

What is claimed is:

1. A method for separating an upright pipe having a lower end embedded in and supported by anchoring material extending into and about the lower end to maintain the pipe in an upright position with the pipe having an open upper end extending above the anchoring material, said method comprising the acts of:

inserting a cutting and augering unit into said pipe through said open upper end, and lowering said unit toward a separation point along said pipe below a top surface of the anchoring material;

augering and removing the anchoring material as said cutting and augering unit approaches said separation point;

separating said upright pipe by advancing a cutting portion of said cutting and augering unit from the inside of said pipe radially through to the outside of said pipe; and, signaling that said separation is complete.

2. The method of claim 1, wherein said act of separating said pipe includes forming and removing chips as the cutting and augering unit advances radially through the pipe.

3. The method of claim 2, wherein said method further includes staying the weight of the pipe and the connected components during the separation process.

4. The method of claim 1, wherein said method further includes staying the weight of the pipe and the connected components during the separation process.

5. A device for separating an upright pipe having a lower end embedded in and supported by anchoring material extending into and about the lower end to maintain the pipe in an upright position said device comprising:

an auger for augering anchoring material having a bit end and a fastening end, said auger being positioned within said pipe, with said bit end below said fastening end and adjacent said anchoring material;

a cutting unit positioned above and supporting said auger at said fastening end, said cutting unit including at least one radially extendable cutting arm for separating the pipe;

a mechanical piston/cylinder drive positioned above and supporting said cutting unit said drive actuating said cutting arm and being pivotally connected thereto;

an extendable hollow shaft positioned above and supporting said mechanical drive;

a supply line for pressurizing said mechanical piston/cylinder drive; and, a signal mechanism for determining when the cutting arm has cut through the pipe so that said mechanical drive can be depressurized.

6. The device of claim 5, wherein said cutting arm includes a pressure-chipping cutting tool moveable radially against the inside circumference of the pipe the tool having a contact point being progressively displaceable in a plane essentially perpendicular to a pipe axis.

7. The device of claim 6, wherein the cutting unit is comprised of a plurality of cutting arms.

8. The device of claim 7, wherein the cutting unit is provided with a cleaning apparatus for cleaning adhering material in an annular region at the separation point down to the inside surface of the pipe.

9. The device of claim 8, including a support apparatus for staying the weight of the pipe during the separation process.

10. The device of claim 5, wherein the cutting unit is provided with a cleaning apparatus for cleaning adhering material in an annular region at the separation point down to the inside surface of the pipe.

11. The device of claim 10, including a support apparatus for staving the weight of the pipe during the separation process.

12. The device of claim 5, including a support apparatus for staying the weight of the pipe during the separation process.

13. The device of claim 12, wherein the support apparatus comprises a support pipe having a length sufficient to extend from an open upper end of said upright pipe to the anchoring material supporting said upright pipe, and said support pipe having a lower end resting on the anchoring material and being connected to said upright pipe near said upper open end of said upright pipe by means of a lift apparatus.

14. The device of claim 13, wherein the support apparatus includes a hydraulically braced conical-tensioning connection between the outside circumference of the support pipe and the inside circumference of the upright pipe.

15. The device of claim 5, wherein said mechanical drive further includes said signal mechanism.

16. The device of claim 5, wherein said supply line is contained within said hollow shaft.

17. A cutting apparatus for separating a leg of an offshore oil rig platform, the leg being a longitudinally extending pipe with a lower end driven into and extending below the ocean floor and an upper end projecting above the ocean surface, the leg being supported by anchoring material extending into and around the lower end of the pipe, and the leg having a desired separation point below the ocean floor within the anchoring material, the apparatus comprising:

an auger for loosening and displacing anchoring material having a bit end and a fastening end, said auger positioned within said pipe, with said bit end below said fastening end and adjacent said anchoring material;

a cutting unit positioned above and supporting said auger at said fastening end, said cutting unit including at least one radially extendable cutting arm for separating the pipe;

a mechanical piston/cylinder drive positioned above and supporting said cutting unit, said drive actuating said cutting arm and being pivotally connected thereto;

an extendable hollow shaft positioned above and supporting said mechanical drive;

a supply line for pressurizing said mechanical drive; and, a signaling mechanism for determining when the cutting arm has cut through said pipe so that said mechanical drive can be depressurized.

18. A cutting apparatus as in claim 17, wherein said cutting unit includes a pressure-chipping cutting tool replaceably attached to said radially extendable cutting arm.

19. A cutting apparatus as in claim 17, wherein said cutting unit includes a cleaning apparatus for loosening anchoring material remaining within said pipe at the desired separation point.

20. A cutting apparatus as in claim 17, wherein said auger includes a suction port for drawing in the displaced anchoring material.

21. The device of claim 17, wherein said mechanical drive further includes said signal mechanism.

22. The device of claim 17, wherein said supply line is contained within said hollow shaft.

23. A cutting apparatus as in claim 17, wherein said cutting unit includes a plurality of radially extendable cutting arms.

24. A cutting apparatus as in claim 23, wherein said cutting unit includes a pressure-chipping cutting tool replaceably attached to each of said radially extendable cutting arms.

25. A method of separating a leg of an offshore oil rig platform, the leg being a longitudinally extending pipe with a lower end driven into and extending below the ocean floor and an upper end projecting above the ocean surface, the leg being supported by anchoring material extending into and around the lower end of the pipe, and the leg having a desired separation point below the ocean floor within the anchoring material, the method comprising the steps of:

inserting a cutting and augering unit into the upper end of the pipe, lowering said cutting and augering unit toward the desired separation point near the lower end of the pipe, and rotating said cutting and augering unit as said unit is being lowered;

displacing the anchoring material using an augering portion of said cutting and augering unit as said unit rotates and descends until said unit reaches the desired separation point;

extending a cutting portion of said cutting and augering unit radially from the inside of the pipe as said cutting and augering unit is rotated, causing separation of the pipe; and, signaling that said separation is complete.

26. A method as in claim 25, wherein said method includes the act of:

suctioning away the anchoring material as the material is displaced.

27. A method as in claim 25, wherein said method includes the act of:

installing a support apparatus within said leg after said leg has been separated, and said cutting and augering unit has been removed.

* * * * *